US008075708B2

(12) United States Patent
Matsukawa et al.

(10) Patent No.: US 8,075,708 B2
(45) **Date of Patent: *Dec. 13, 2011**

(54) PRETREATMENT METHOD FOR COATING

(75) Inventors: Masahiko Matsukawa, Nishitokyo (JP); Kazuhiro Makino, Yokohama (JP); Toshiaki Shimakura, Ichikawa (JP); Masanobu Futsuhara, Yokohama (JP); Jiping Yang, Shinagawa-ku (JP)

(73) Assignee: Nippon Paint Co., Ltd., Kita-ku, Osaka-shi (JP)

( * ) Notice: Subject to any disclaimer, the term of this patent is extended or adjusted under 35 U.S.C. 154(b) by 49 days.

This patent is subject to a terminal disclaimer.

(21) Appl. No.: 10/743,387

(22) Filed: Dec. 23, 2003

(65) Prior Publication Data

US 2004/0163736 A1 Aug. 26, 2004

(30) Foreign Application Priority Data

Dec. 24, 2002 (JP) ..... 2002-372770
Dec. 24, 2002 (JP) ..... 2002-372772
Dec. 2, 2003 (JP) ..... 2003-403688

(51) Int. Cl.
*C23C 22/50* (2006.01)

(52) U.S. Cl. ..... 148/247; 148/243; 148/274; 148/279; 106/14.05; 106/14.11; 106/14.15

(58) Field of Classification Search ..... 448/427; 148/243, 247, 254, 275, 274, 279; 106/14.05, 106/14.11, 14.15, 14.21; 205/210, 213, 217
See application file for complete search history.

(56) References Cited

U.S. PATENT DOCUMENTS

| | | | | |
|---|---|---|---|---|
| 3,682,713 | A | 8/1972 | Ries et al. | |
| 3,964,936 | A * | 6/1976 | Das | 148/273 |
| 4,130,431 | A * | 12/1978 | Kogure | 106/14.33 |
| 4,148,670 | A * | 4/1979 | Kelly | 148/247 |
| 4,338,140 | A | 7/1982 | Reghi | |
| 4,828,615 | A * | 5/1989 | Cape | 106/14.13 |
| 5,270,428 | A * | 12/1993 | Castellucci | 528/38 |
| 6,180,177 | B1 * | 1/2001 | Nagashima et al. | 427/388.4 |
| 6,193,815 | B1 * | 2/2001 | Wada et al. | 148/247 |
| 6,203,854 | B1 * | 3/2001 | Affinito | 427/327 |
| 6,514,357 | B1 * | 2/2003 | Tada et al. | 148/251 |
| 6,607,610 | B1 * | 8/2003 | Carey et al. | 148/247 |
| 7,250,193 | B2 * | 7/2007 | Matsukawa et al. | 427/388.1 |
| 2001/0037748 | A1 * | 11/2001 | Shimakura et al. | 106/14.44 |
| 2001/0042491 | A1 | 11/2001 | Shimakura et al. | |
| 2002/0175082 | A1 * | 11/2002 | Sakamoto et al. | 205/499 |
| 2003/0185990 | A1 * | 10/2003 | Bittner et al. | 427/385.5 |
| 2003/0221751 | A1 * | 12/2003 | Claffey et al. | 148/247 |
| 2004/0009300 | A1 * | 1/2004 | Shimakura et al. | 427/407.1 |
| 2004/0094235 | A1 * | 5/2004 | Rodzewich et al. | 148/243 |
| 2004/0224168 | A1 * | 11/2004 | Jennings et al. | 428/447 |

FOREIGN PATENT DOCUMENTS

| | | | |
|---|---|---|---|
| CA | 2273907 | A1 | 4/1999 |
| CA | 2355855 | A1 | 5/2001 |
| CN | 1332213 | | 1/2002 |
| DE | 199 33 189 | A1 | 1/2001 |
| EP | 0 153 973 | A1 | 9/1985 |
| EP | 0 949 353 | A1 | 10/1999 |
| EP | 1 130 131 | A2 | 9/2001 |
| EP | 1 130 132 | A2 | 9/2001 |
| EP | 1 130 133 | A2 | 9/2001 |
| EP | 1130132 | | 9/2001 |
| EP | 1130132 | A2 * | 9/2001 |
| EP | 1130132 | A3 * | 9/2001 |
| EP | 1130133 | A2 * | 9/2001 |
| EP | 1130133 | A3 * | 2/2002 |
| JP | 48-24618 | | 7/1973 |
| JP | 57-41377 | A | 3/1982 |
| JP | 59-064781 | * | 1/1984 |
| JP | 59-064781 | | 4/1984 |
| JP | 59-083775 | | 5/1984 |
| JP | 59083775 | | 5/1984 |
| JP | 61-182940 | | 8/1986 |
| JP | S61-182940 | | 8/1986 |
| JP | 63-219587 | | 9/1988 |
| JP | S63-219587 | | 9/1988 |
| JP | 02-240295 | * | 9/1990 |
| JP | 5117869 | | 5/1993 |
| JP | 05-195244 | A | 8/1993 |
| JP | 05-287549 | | 11/1993 |
| JP | H05-287549 | | 11/1993 |
| JP | 7145486 | | 6/1995 |
| JP | 7-310189 | | 11/1995 |
| JP | 08-073775 | | 3/1996 |
| JP | 08-333528 | | 12/1996 |

(Continued)

OTHER PUBLICATIONS

Office Action issued in corresponding Chinese Patent Application No. 200310113012.7 on Feb. 15, 2008.

Notice of Reasons for Rejection issued to Canadian Patent Application No. 2,454,042, mailed Nov. 17, 2009.

Office Action issued in corresponding Canadian Application No. 2,454,042 mailed Jan. 27, 2011.

*Primary Examiner* — Roy King
*Assistant Examiner* — Lois Zheng
(74) *Attorney, Agent, or Firm* — Connolly Bove Lodge & Hutz LLP

(57) ABSTRACT

It is an object of the present invention to provide a pretreatment method for coating, which does not limit a coating method, places a less burden on the environment and can apply good chemical conversion treatment to all metals such as iron, zinc, aluminum and so on.

A pretreatment method for coating comprising treating a substance to be treated by a chemical conversion coating agent to form a chemical conversion coat, wherein the chemical conversion coating agent comprises: at least one kind selected from the group consisting of zirconium, titanium and hafnium; fluorine; and at least one kind selected from the group consisting of amino group-containing silane coupling agents, hydrolysates thereof and polymers thereof.

9 Claims, No Drawings

FOREIGN PATENT DOCUMENTS

| | | | |
|---|---|---|---|
| JP | H08-333528 | | 12/1996 |
| JP | 09-025436 | A | 1/1997 |
| JP | 9-503823 | | 4/1997 |
| JP | 9503823 | | 4/1997 |
| JP | 09-241587 | | 9/1997 |
| JP | 10-018093 | A | 1/1998 |
| JP | 10046101 | | 2/1998 |
| JP | 10505636 | | 6/1998 |
| JP | 10-204649 | | 8/1998 |
| JP | 11-106945 | A | 4/1999 |
| JP | 11-229156 | | 8/1999 |
| JP | 2000-263065 | | 9/2000 |
| JP | 2000-282251 | | 10/2000 |
| JP | 2000-309879 | A | 11/2000 |
| JP | 2001-049453 | A | 2/2001 |
| JP | 2001-240979 | A | 9/2001 |
| JP | 2001-293427 | | 10/2001 |
| JP | 2001-516810 | | 10/2001 |
| JP | 2001-316845 | | 11/2001 |
| JP | 2002-088492 | | 3/2002 |
| JP | 2002-105358 | | 4/2002 |
| JP | 2003-155578 | | 5/2003 |
| JP | 2003-286289 | A | 10/2003 |
| WO | WO-93/09265 | | 5/1993 |
| WO | WO-95/04169 | | 2/1995 |
| WO | WO-95-10641 | | 4/1995 |
| WO | WO-95/10641 | | 4/1995 |
| WO | WO-95/21277 | A1 | 8/1995 |
| WO | WO-96/07772 | | 3/1996 |
| WO | WO-98/05804 | | 2/1998 |
| WO | WO-98/16324 | A1 | 4/1998 |
| WO | WO-99/14399 | A1 | 3/1999 |
| WO | WO9914399 | * | 3/1999 |
| WO | WO-01/12876 | A1 | 2/2001 |
| WO | WO-01/86016 | A2 | 11/2001 |
| WO | WO-0186016 | A2 | 11/2001 |
| WO | WO-02/103080 | A1 | 12/2002 |

* cited by examiner

PRETREATMENT METHOD FOR COATING

TECHNICAL FIELD

The present invention relates to a pretreatment method for coating.

BACKGROUND ART

When a cationic electrocoating or a powder coating is applied to the surface of a metal material, a chemical conversion treatment is generally applied in order to improve the properties such as corrosion resistance and adhesion to a coating film. With respect to a chromate treatment used in the chemical conversion treatment, from the viewpoint of being able to further improve the adhesion to a coating film and the corrosion resistance, in recent years, a harmful effect of chromium has been pointed and the development of a chemical conversion coating agent containing no chromium is required. As such a chemical conversion treatment, a treatment using zinc phosphate is widely adopted (cf. Japanese Kokai Publication Hei-10-204649, for instance).

However, since treating agents based on zinc phosphate have high concentrations of metal ions and acids and are very active, these are economically disadvantageous and low in workability in a wastewater treatment. Further, there is a problem of formation and precipitation of salts, being insoluble in water, associated with the metal surface treatment using treating agents based on zinc phosphate. Such a precipitated substance is generally referred to as sludge and increases in cost for removal and disposal of such sludge become problems. In addition, since phosphate ions have a possibility of placing a burden on the environment due to eutrophication, it takes efforts for treating wastewater; therefore, it is preferably not used. Further, there is also a problem that in a metal surface treatment using treating agents based on zinc phosphate, a surface conditioning is required; therefore, a treatment process become long.

As a metal surface treating agent other than such a treating agent based on zinc phosphate or a chemical conversion coating agent of chromate, there is known a metal surface treating agent comprising a zirconium compound (cf. Japanese Kokai Publication Hei-07-310189, for instance). Such a metal surface treating agent comprising a zirconium compound has an excellent property in point of suppressing the generation of the sludge in comparison with the treating agent based on zinc phosphate described above.

However, a chemical conversion coat attained by the metal surface treating agent comprising a zirconium compound is poor in the adhesion to coating films attained by cationic electrocoating in particular, and usually less used as a pretreatment for cationic electrocoating. In such the metal surface treating agent comprising a zirconium compound, efforts to improve the adhesion and the corrosion resistance by using it in conjunction with another component such as phosphate ions are being made. However, when it is used in conjunction with the phosphate ions, a problem of the eutrophication will arise as described above. In addition, there has been no study on using such treatment using a metal surface treating agent as a pretreatment method for various coatings such as cationic electrocoating. Further, there was a problem that when an iron material was treated with such the metal surface treating agent, the adequate adhesion to a coating film and the corrosion resistance after coating could not be attained.

A non-chromate metal surface treating agent comprising a zirconium compound and an amino group-containing silane coupling agent is also known (cf. Japanese Kokai Publication 2001-316845, for instance). However, such a non-chromate metal surface treating agent is an application type treating agent used for coil coating, and in a surface treatment by such a non-chromate metal surface treating agent, it is not possible to perform a postrinsing after treating and a substance to be treated having a complex configuration is not considered.

Further, surface treatment of all metals have to be performed by one step of treatment to articles including various metal materials such as iron, zinc and aluminum for bodies and parts of automobiles in some cases. Accordingly there is desired the development of pretreatment method for coating which can apply a chemical conversion treatment without problems even in such a case. Further, there is desired the development of pretreatment method which can apply a chemical conversion treatment without problems as mentioned above, when other coatings using powder coating composition, organic solvent coating composition, and waterborne coating composition besides cationic electrocoating and anionic electrocoating are applied.

SUMMARY OF THE INVENTION

In consideration of the above circumstances, it is an object of the present invention to provide a pretreatment method for coating, which does not limit a coating method, places a less burden on the environment and can apply good chemical conversion treatment to all metals such as iron, zinc, aluminum and so on.

The present invention is directed to a pretreatment method for coating comprising treating a substance to be treated by a chemical conversion coating agent to form a chemical conversion coat, wherein the chemical conversion coating agent comprises: at least one kind selected from the group consisting of zirconium, titanium and hafnium; fluorine; and at least one kind selected from the group consisting of amino group-containing silane coupling agents, hydrolysates thereof and polymers thereof.

Preferably, at least one kind selected from the group consisting of amino group-containing silane coupling agents, hydrolysates thereof and polymers thereof has a content of 5 to 5000 ppm as a concentration of solid matter.

Preferably, the chemical conversion coating agent contains 1 to 5000 ppm of at least one kind of a chemical conversion reaction accelerator selected from the group consisting of nitrite ion, nitro group-containing compounds, hydroxylamine sulfate, persulfate ion, sulfite ion, hyposulfite ion, peroxides, iron (III) ion, citric acid iron compounds, bromate ion, perchlorinate ion, chlorate ion, chlorite ion, as well as ascorbic acid, citric acid, tartaric acid, malonic acid, succinic acid and salts thereof.

Preferably, the chemical conversion coating agent contains 20 to 10000 ppm of at least one kind selected from the group consisting of zirconium, titanium and hafnium in terms of metal, and has a pH of 1.5 to 6.5.

Preferably, the chemical conversion coating agent contains at least one kind of adhesion and corrosion resistance imparting agent selected from the group consisting of magnesium ion, zinc ion, calcium ion, aluminum ion, gallium ion, indium ion and copper ion.

DETAILED DESCRIPTION OF THE INVENTION

Hereinafter, the present invention will be described in detail.

The present invention is directed to a pretreatment method for coating, which uses a chemical conversion coating agent containing at least one kind selected from the group consisting of zirconium, titanium and hafnium, and fluorine and substantially containing no phosphate ions and harmful heavy metal ions. When a substance is treated with conventional chemical conversion coating agents containing zirconium and the like in place of a zinc phosphate treatment which is generally used as a chemical conversion treatment method, a problem that sufficient adhesion to a coating film cannot be attained particularly in an iron material arises. Therefore, the present invention is directed to a pretreatment method for coating capable of resolving the above problem and forming a chemical conversion coat having sufficient adhesion to a coating film even for the iron material by using a chemical conversion coating agent comprising at least one kind selected from the group consisting of zirconium, titanium and hafnium, and fluorine.

At least one kind selected from the group consisting of zirconium, titanium and hafnium contained in the chemical conversion coating agent used in the present invention is a component constituting a chemical conversion coat and, by forming a chemical conversion coat including at least one kind selected from the group consisting of zirconium, titanium and hafnium on a material, the corrosion resistance and the abrasion resistance of the material can be improved and further the adhesion to the coating film can be enhanced.

For example, in a metal surface treatment using a zirconium containing chemical conversion coating agent, it is considered that hydroxide or oxide of zirconium is deposited on the surface of the base material because metal ions elutes in the chemical conversion coating agent through a dissolution reaction of the metal and pH at an interface increases. As mentioned above, the chemical conversion coating agent in the present invention is a reaction type treating agent, so the chemical conversion coating agent can be applied to an immersion treatment of a substance having a complex configuration. Further, in a surface treatment using the chemical conversion coating agent, postrinsing after treating can be performed because of forming a chemical conversion coat adhered firmly to a substance by a chemical reaction.

A supply source of the zirconium is not particularly limited, and examples thereof include alkaline metal fluoro-zirconate such as $K_2ZrF_6$, fluoro-zirconate such as $(NH_4)_2ZrF_6$, soluble fluoro-zirconate like fluoro-zirconate acid such as $H_2ZrF_6$, zirconium fluoride, zirconium oxide and the like.

A supply source of the titanium is not particularly limited, and examples thereof include alkaline metal fluoro-titanate, fluoro-titanate such as $(NH_4)_2TiF_6$, soluble fluoro-titanate like fluoro-titanate acid such as $H_2TiF_6$, titanium fluoride, titanium oxide and the like.

A supply source of the hafnium is not particularly limited, and examples thereof include fluoro-hafnate acid such as $H_2HfF_6$, hafnium fluoride and the like.

As a supply source of at least one kind selected from the group consisting of zirconium, titanium and hafnium, a compound having at least one kind selected from the group consisting of $ZrF_6^{2-}$, $TiF_6^{2-}$ and $HfF_6^{2-}$ is preferable because of high ability of forming a coat.

Preferably, the content of at least one kind selected from the group consisting of zirconium, titanium and hafnium, which is contained in the chemical conversion coating agent is within a range from 20 ppm of a lower limit to 10000 ppm of an upper limit in terms of metal. When the content is less than the above lower limit, the performance of the chemical conversion coat to be obtained is inadequate, and when the content exceeds the above upper limit, it is economically disadvantageous because further improvements of the performances cannot be expected. More preferably, the lower limit is 50 ppm and the upper limit is 2000 ppm.

Fluorine contained in the chemical conversion coating agent serves as an etchant of a material. A supply source of the fluorine is not particularly limited, and examples thereof may include fluorides such as hydrofluoric acid, ammonium fluoride, fluoboric acid, ammonium hydrogenfluoride, sodium fluoride and sodium hydrogenfluoride. In addition, an example of complex fluoride includes hexafluorosilicate, and specific examples thereof may include hydrosilicofluoric acid, zinc hydrosilicofluoride, manganese hydrosilicofluoride, magnesium hydrosilicofluoride, nickel hydrosilicofluoride, iron hydrosilicofluoride, calcium hydrosilicofluoride and the like.

The chemical conversion coating agent contains at least one kind selected from the group consisting of amino group-containing silane coupling agents, hydrolysates thereof and polymers thereof. The amino group-containing silane coupling agent is a compound having at least an amino group and having a siloxane linkage in a molecule. Containing at least one kind selected from the group consisting of amino group-containing silane coupling agents, hydrolysates thereof and polymers thereof enables to act on both of a chemical conversion coat and a coating film, and adhesion between both coats is improved.

It is estimated that the adhesion between the chemical conversion coat and the metal material is enhanced by that a group, which produces silanol through hydrolysis, is hydrolyzed and adsorbs to the surface of the metal material in the form of a hydrogen bond and by the action of an amino group. It is considered that at least one kind selected from the group consisting of amino group-containing silane coupling agents, hydrolysates thereof and polymers thereof contained in the chemical conversion coat has the action of enhancing the mutual adhesion by acting on both of the metal material and the coating film as described above.

The amino group-containing silane coupling agent is not particularly limited, and examples thereof may include publicly known silane coupling agents such as N-2(aminoethyl) 3-aminopropylmethyldimethoxysilane, N-2(aminoethyl)3-aminopropyltrimethoxysilane, N-2(aminoethyl)3-aminopropyltriethoxysilane, 3-aminopropyltrimethoxysilane, 3-aminopropyltriethoxysilane, 3-triethoxysilyl-N-(1,3-dimethyl-butylidene)propylamine, N-phenyl-3-aminopropyltrimethoxysilane and N,N-bis[3-(trimethoxysilyl)propyl]ethylenediamine. KBM-602, KBM-603, KBE-603, KBM-903, KBE-9103 and KBM-573 (each manufactured by Shin-Etsu Chemical Co., Ltd.) and XS 1003 (manufactured by Chisso Co., Ltd.), which are commercially available amino group-containing silane coupling agents, may also be used.

The hydrolysate of the above amino group-containing silane coupling agent can be produced by a publicly known method, for example, a method of dissolving the amino group-containing silane coupling agent in ion-exchanged water to adjust the solution to be acidic with any acid. As the hydrolysate of the amino group-containing silane coupling agent, commercially available products such as KBP-90 (manufactured by Shin-Etsu Chemical Co., Ltd., effective ingredient: 32%) may also be used.

The polymer of the above amino group-containing silane coupling agent is not particularly limited, and examples thereof may include commercially available products such as Sila-Ace S-330 (γ-aminopropyltriethoxysilane; manufactured by Chisso Co., Ltd.), Sila-Ace S-320 (N-(2-aminoethyl)-3-aminopropyltrimethoxysilane; manufactured by Chisso Co., Ltd.) and the like.

The amino group-containing silane coupling agent and hydrolysate thereof are suitably used in a pretreatment especially for cationic electrocoating. On the other hand, the polymer of the amino group-containing silane coupling agent can be suitably used in a pretreatment not only for cationic electrocoating, but also for coating with organic solvent coating composition, water-borne coating composition, powder coating composition and so on.

Preferably, the blending amount of at least one kind selected from the group consisting of amino group-containing silane coupling agents, hydrolysates thereof and polymers thereof in the chemical conversion coating agent is within a range from 5 ppm of a lower limit to 5000 ppm of an upper limit as a concentration of solid matter. When the blending amount is less than 5 ppm, the adequate adhesion to a coating film cannot be attained. When it exceeds 5000 ppm, it is economically disadvantageous because further improvements of the performances cannot be desired. The above-mentioned lower limit is more preferably 10 ppm and still more preferably 50 ppm. The above-mentioned upper limit is more preferably 1000 ppm and still more preferably 500 ppm.

Preferably, the chemical conversion coating agent of the present invention further contains a chemical conversion reaction accelerator. The chemical conversion reaction accelerator has an effect of suppressing unevenness of the surface of a chemical conversion coat obtained using a metal surface treating agent comprising a zirconium compound. An amount of a coat precipitated is different depending on the difference of location between an edge portion and a flat portion of a material; thereby, the unevenness of the surface is generated. Therefore, when a metal material having an edge portion is treated with a conventional surface treating agent comprising a zirconium compound, since an anodic dissolution reaction occurs selectively at an edge portion, a cathodic reaction becomes prone to occur and, consequently, a coat tends to precipitate around the edge portion and an anodic dissolution reaction hardly occur in a flat portion and precipitation of a coat is suppressed, and this results in unevenness of the surface.

In the chemical conversion treatment of zinc phosphate, since the resulting chemical conversion coat is a thick film type, the unevenness of the surface does not turn into problems so much. However, since the chemical conversion coat comprising a zirconium compound is a thin film type, when a sufficient amount of a coat is not attained at a flat portion to which the chemical conversion treatment is hardly applied, this causes uneven coating and problems may arise in appearance of a coating and corrosion resistance.

The chemical conversion reaction accelerator in the present invention has a property to act in such a manner that the chemical conversion treatment may be applied without developing a difference of a chemical conversion treatment reaction between the edge portion and the flat portion described above by being blended in the chemical conversion coating agent.

Although the chemical conversion reaction accelerator is at least one kind selected from the group consisting of nitrite ions, nitro group-containing compounds, hydroxylamine sulfate, persulfate ions, sulfite ions, hyposulfite ions, peroxides, iron (III) ions, citric acid iron compounds, bromate ions, perchlorinate ions, chlorate ions, chlorite ions as well as ascorbic acid, citric acid, tartaric acid, malonic acid, succinic acid and salts thereof, in particular, a substance having an oxidizing action or an organic acid is preferable for accelerating etching efficiently.

By blending these chemical conversion reaction accelerators in the chemical conversion coating agent, unbalanced coat-precipitation is adjusted and good chemical conversion coat having no unevenness in an edge portion and a flat portion of a material can be attained.

A supply source of the nitrite ion is not particularly limited, and examples thereof include sodium nitrite, potassium nitrite, ammonium nitrite and the like. The nitro group-containing compound is not particularly limited, and examples thereof include nitrobenzenesulfonic acid, nitroguanidine and the like. A supply source of the persulfate ion is not particularly limited, and examples thereof include $Na_2S_2O_8$, $K_2S_2O_8$ and the like. A supply source of the sulfite ion is not particularly limited, and examples thereof include sodium sulfite, potassium sulfite, ammonium sulfite and the like. A supply source of the hyposulfite ion is not particularly limited, and examples thereof include sodium hyposulfite, potassium hyposulfite, ammonium hyposulfite and the like. The peroxides is not particularly limited, and examples thereof include hydrogen peroxide, sodium peroxide, potassium peroxide and the like.

A supply source of the iron (III) ion is not particularly limited, and examples thereof include ferric nitrate, ferric sulfate, ferric chloride and the like. The citric acid iron compound is not particularly limited, and examples thereof include citric acid iron ammonium, citric acid iron sodium, citric acid iron potassium and the like. A supply source of the bromate ion is not particularly limited, and examples thereof include sodium bromate, potassium bromate, ammonium bromate and the like. A supply source of the perchlorinate ion is not particularly limited, and examples thereof include sodium perchlorinate, potassium perchlorinate, ammonium perchlorinate and the like.

A supply source of the chlorate ion is not particularly limited, and examples thereof include sodium chlorate, potassium chlorate, ammonium chlorate and the like. A supply source of the chlorite ion is not particularly limited, and examples thereof include sodium chlorite, potassium chlorite, ammonium chlorite and the like. The ascorbic acid and salt thereof are not particularly limited, and examples thereof include ascorbic acid, sodium ascorbate, potassium ascorbate, ammonium ascorbate and the like. The citric acid and salt thereof are not particularly limited, and examples thereof include citric acid, sodium citrate, potassium citrate, ammonium citrate and the like. The tartaric acid and salt thereof are not particularly limited, and examples thereof include tartaric acid, ammonium tartrate, potassium tartrate, sodium tartrate and the like. The malonic acid and salt thereof are not particularly limited, and examples thereof include malonic acid, ammonium malonate, potassium malonate, sodium malonate and the like. The succinic acid and salt thereof are not particularly limited, and examples thereof include succinic acid, sodium succinate, potassium succinate, ammonium succinate and the like.

The above-described chemical conversion reaction accelerators may be used alone or in combination of two or more kinds of components as required.

A blending amount of the chemical conversion reaction accelerator in the chemical conversion coating agent of the present invention is preferably within a range from 1 ppm of a lower limit to 5000 ppm of an upper limit. When it is less than 1 ppm, it is not preferred because an adequate effect cannot be attained. When it exceeds 5000 ppm, there is a possibility of inhibiting coat formation. The above lower limit is more preferably 3 ppm and further more preferably 5 ppm. The above upper limit is more preferably 2000 ppm and further more preferably 1500 ppm.

Preferably, the chemical conversion coating agent substantially contains no phosphate ions. Substantially containing no phosphate ions means that phosphate ions are not contained to such an extent that the phosphate ions act as a component in the chemical conversion coating agent. Since the chemical conversion coating agent used in the present invention substantially contains no phosphate ions, phosphorus causing a burden on the environment is not substantially used and the formation of the sludge such as iron phosphate and zinc phosphate, formed in the case of using a treating agent based on zinc phosphate, can be suppressed.

In the chemical conversion coating agent, preferably, a pH is within a range from 1.5 of a lower limit to 6.5 of an upper limit. When the pH is less than 1.5, etching becomes excessive; therefore, adequate coat formation becomes impossible. When it exceeds 6.5, etching becomes insufficient; therefore, a good coat cannot be attained. More preferably, the above lower limit is 2.0 and the above upper limit is 5.5. Still more preferably, the above lower limit is 2.5 and the above upper limit is 5.0. In order to control the pH of the chemical conversion coating agent, there can be used acidic compounds such as nitric acid and sulfuric acid, and basic compounds such as sodium hydroxide, potassium hydroxide and ammonia.

Preferably, the chemical conversion coating agent contains at least one kind selected from the group consisting of magnesium ion, zinc ion, calcium ion, aluminum ion, gallium ion, indium ion and copper ion as an adhesion and corrosion resistance imparting agent. By containing the adhesion and corrosion resistance imparting agent, the chemical conversion coating agent can form a chemical conversion coat having more excellent adhesion and corrosion resistance.

Preferably, the content of at least one kind selected from the group consisting of magnesium ion, zinc ion, calcium ion, aluminum ion, gallium ion, indium ion and copper ion is within a range from 1 ppm of a lower limit to 5000 ppm of an upper limit. When the content is less than the lower limit, it is not preferable because the adequate effect cannot be attained. When it exceeds the upper limit, it is economically disadvantageous because further improvements of the effect are not recognized; and, there is a possibility that the adhesion after coating is deteriorated. The above-mentioned lower limit is more preferably 25 ppm and the above-mentioned upper limit is more preferably 3000 ppm.

The chemical conversion coating agent used in the present invention may be used in combination with an arbitrary component other than the above-mentioned components as required. Examples of the component which can be used include silica and the like. By adding the components, the corrosion resistance after coating can be enhanced.

In the pretreatment method for coating of the present invention, the chemical conversion treatment is not particularly limited, and this can be performed by bringing a chemical conversion coating agent into contact with a surface of metal in usual treatment conditions. Preferably, a treatment temperature in the above-mentioned chemical conversion treatment is within a range from 20° C. of a lower limit to 70° C. of an upper limit. More preferably, the above-mentioned lower limit is 30° C. and the above-mentioned upper limit is 50° C. Preferably, a treatment time in the chemical conversion treatment is within a range from 5 seconds of a lower limit to 1,200 seconds of an upper limit. More preferably, the above-mentioned lower limit is 30 seconds and the above-mentioned upper limit is 120 seconds. The chemical conversion treatment method is not particularly limited, and examples thereof include an immersion method, a spray coating method, a roller coating method and the like.

In the pretreatment method for coating of the present invention, the surface of a metal material is preferably degreased and rinsed with water after being degreased before the chemical conversion treatment is applied, and postrinsed after the chemical conversion treatment.

The above degreasing is performed to remove an oil matter or a stain adhered to the surface of the material, and immersion treatment is conducted usually at 30 to 55° C. for about several minutes with a degreasing agent such as phosphate-free and nitrogen-free cleaning liquid for degreasing. It is also possible to perform pre-degreasing before degreasing as required.

The above rinsing with water after degreasing is performed by spraying once or more with a large amount of water for rinsing in order to rinse a degreasing agent after degreasing.

The above postrinsing after the chemical conversion treatment is performed once or more in order to prevent the chemical conversion treatment from adversely affecting to the adhesion and the corrosion resistance after the subsequent various coating applications. In this case, it is proper to perform the final rinsing with pure water. In this postrinsing after the chemical conversion treatment, either spray rinsing or immersion rinsing may be used, and a combination of these rinsing may be adopted.

After the above postrinsing after the chemical conversion treatment, the surface of the metal material is dried as required according to a publicly known method and then various coating can be performed.

In addition, since the pretreatment method for coating of the present invention does not need to perform a surface conditioning which is required in a method of treating using the zinc phosphate-based chemical conversion coating agent which is conventionally in the actual use, the chemical conversion treatment of metal can be performed in fewer steps.

Examples of a metal material treated in the present invention include an iron material, an aluminum material, a zinc material and the like. Iron, aluminum and zinc materials mean an iron material in which a material comprises iron and/or its alloy, an aluminum material in which a material comprises aluminum and/or its alloy and a zinc material in which a material comprises zinc and/or its alloy, respectively. The pretreatment method for coating of the present invention can also be used for a substance to be coated comprising a plurality of metal materials among the iron material, the aluminum material and the zinc material.

The pretreatment method for coating of the present invention is preferable in that this method can impart the adequate adhesion to a coating film to iron materials in which it is hard to attain adequate adhesion to coating films by a pretreatment using usual chemical conversion coating agents containing zirconium and the like. Therefore, the pretreatment method for coating of the present invention has an excellent property particularly in point of being applicable for treating a substance which contains an iron material at least in part.

The iron material is not particularly limited, and examples thereof include a cold-rolled steel sheet, a hot-rolled steel sheet and the like. The aluminum material is not particularly limited, and examples thereof include 5000 series aluminum alloy, 6000 series aluminum alloy and the like. The zinc material is not particularly limited, and examples thereof include steel sheets, which are plated with zinc or a zinc-based alloy through electroplating, hot dipping and vacuum evaporation coating, such as a galvanized steel sheet, a steel sheet plated with a zinc-nickel alloy, a steel sheet plated with a zinc-iron alloy, a steel sheet plated with a zinc-chromium alloy, a steel sheet plated with a zinc-aluminum alloy, a steel sheet plated with a zinc-titanium alloy, a steel sheet plated with a zinc-magnesium alloy and a steel sheet plated with a zinc-manganese alloy, and the like. In the present invention, chemical conversion treatment with iron, aluminum and zinc materials can be conducted simultaneously.

Preferably, a coat amount of the chemical conversion coats attained in the pretreatment method for coating of the present invention is within a range from 0.1 mg/m$^2$ of a lower limit to 500 mg/m$^2$ of an upper limit in a total amount of metals contained in the chemical conversion coating agent. When this amount is less than 0.1 mg/m$^2$, it is not preferable because a uniform chemical conversion coat cannot be attained. When it exceeds 500 mg/m$^2$, it is economically disadvantageous because further improvements of the performances cannot be obtained. More preferably, the above-mentioned lower limit is 5 mg/m$^2$ and the above-mentioned upper limit is 200 mg/m$^2$.

A coating can be applied to the metal material to be treated by the pretreatment method for coating of the present invention is not particularly limited, and examples thereof may include coatings using a cationic electrodeposition coating composition, organic solvent coating composition, water-borne coating composition, powder coating composition and soon. For example, the cationic electrodeposition coating composition is not particularly limited, and a conventionally publicly known cationic electrodeposition coating composition comprising aminated epoxy resin, aminated acrylic resin, sulfonated epoxy resin and the like can be applied. Among them, since the chemical conversion coating agent is blended with at least one kind selected from the group consisting of amino group-containing silane coupling agents, hydrolysates thereof and polymers thereof, a cationic electrodeposition coating composition, which comprises resin having a functional group exhibiting the reactivity or the compatibility with an amino group, is preferable in order to further enhance the adhesion between the electrodeposition coating film and the chemical conversion coat.

Since the chemical conversion coating agent in the present invention contains at least one kind selected from the group consisting of zirconium, titanium and hafnium as a component constituting the chemical conversion coat and, further at least one kind selected from the group consisting of amino group-containing silane coupling agents, hydrolysates thereof and polymers thereof, the pretreatment method for coating of the present invention can apply a good pretreatment for coating which has been generally performed by a treating agent based on zinc phosphate. Further, a chemical conversion coat excellent in adhesion to a coating film can be formed even for iron materials for which pretreatment by the conventional chemical conversion coating agent containing zirconium and the like is not suitable, according to the present invention. In addition, since the chemical conversion coating agent used in the present invention contains substantially no phosphate ions, the burden on the environment is less and the sludge is not formed. Further, the pretreatment method for coating of the present invention can perform the chemical conversion treatment of metal material in fewer steps since it does not require the steps of surface conditioning.

The present invention provides a pretreatment method for coating which places a less burden on the environment and can apply good chemical conversion treatment to all metals such as iron, zinc, aluminum and so on. In addition, since a good chemical conversion coat can be formed without performing surface conditioning in the pretreatment method for coating of the present invention, the method is excellent in workability and cost.

EXAMPLES

Hereinafter, the present invention will be described in more detail by way of examples, but the present invention is not limited to these examples.

Example 1

A commercially available cold-rolled steel sheet (SPCC-SD, manufactured by Nippon Testpanel Co., Ltd., 70 mm×150 mm×0.8 mm) was used as a material, and pretreatment of coating was applied to the material in the following conditions.

(1) Pretreatment of Coating

Degreasing treatment: The metal material was immersed at 40° C. for 2 minutes with 2% by mass "SURF CLEANER 53" (degreasing agent manufactured by Nippon Paint Co., Ltd.).

Rinsing with water after degreasing: The metal material was rinsed for 30 seconds with a spray of running water.

Chemical conversion treatment: A chemical conversion coating agent, having the zirconium concentration of 100 ppm and the amino group-containing silane coupling agent concentration of 100 ppm as a concentration of solid matter, was prepared by using fluorozirconic acid and KBM-603 (N-2(aminoethyl)3-aminopropyltrimethoxysilane, effective concentration: 100%, manufactured by Shin-Etsu Chemical Co., Ltd.) as the amino group-containing silane coupling agent. A pH was adjusted to be 4 by using sodium hydroxide. The temperature of the chemical conversion coating agent was controlled at 40° C. and the metal material was immersed for 60 seconds. A coat amount at an initial stage of treatment was 10 mg/m$^2$.

Rinsing after chemical conversion treatment: The metal material was rinsed for 30 seconds with a spray of running water. Further, the metal material was rinsed for 10 seconds with a spray of ion-exchanged water. Then, electrocoating was applied to the metal material in a wet condition. It is noted that a coat amount was analyzed as a total amount of metals contained in the chemical conversion coating agent by using "XRF-1700" (X-ray fluorescence spectrometer manufactured by Shimadzu Co., Ltd.) after the cold-rolled steel sheet after rinsing was dried at 80° C. for 5 minutes in an electrical dryer.

(2) Coating

After 1 m$^2$ of the surface of the cold-rolled steel sheet was treated per 1 liter of the chemical conversion coating agent, electrocoating was applied to the surface in such a manner that a dried film thickness was 20 μm using "POWERNIX 110" (a cationic electrodeposition coating composition manufactured by Nippon Paint Co., Ltd.) and, after rinsing with water, the metal material was heated and baked at 170° C. for 20 minutes and test sheets were prepared.

Evaluation Test

<Observation of Sludge>

After 1 m$^2$ of the surface of the metal material was treated per 1 liter of the chemical conversion coating agent, haze in the chemical conversion coating agent was visually observed.

○: There is not haze

X: There is haze

<Secondary Adhesion Test (SDT)>

Two parallel lines, which have depth reaching the material, were cut in a longitudinal direction on the obtained test sheet and then the test sheet was immersed at 50° C. for 480 hours in 5% aqueous solution of NaCl. After immersion, a cut portion was peeled off with an adhesive tape and peeling of a coating was observed.

◎: No peeled

○: Slightly peeled

X: Peeled 3 mm or more in width

<SST>

The test sheet was scored in a cross to the depth reaching the material and then the test sheet was sprayed with 5% aqueous solution of NaCl for 240 hours in a salt spray tester at 35° C. After spraying, a bulge width at the cut portion was measured.

<Humidity Resistance Test>

The test sheet was allowed in a thermo-hygrostat (humidity: 95%, temperature: 50° C.) for 240 hours and then the test sheet was allowed for a hour in the atmosphere. After allowing, the test sheet was scored in a cross of 100 squares (1 mm×1 mm) and peeled off with an adhesive tape. The remained number of the coating film was measured to evaluate adhesion to a coating film.

Example 2

The test sheet was prepared by following the same procedure as that of Example 1 except that KBM-903 (3-aminopropyltrimethoxysilane, effective concentration: 100%, manufactured by Shin-Etsu Chemical Co., Ltd.) was used as the amino group-containing silane coupling agent.

Example 3

The test sheet was prepared by following the same procedure as that of Example 1 except that KBE-903 (3-aminopropyltriethoxysilane, effective concentration: 100%, manufactured by Shin-Etsu Chemical Co., Ltd.) was used as the amino group-containing silane coupling agent.

Example 4

The test sheet was prepared by following the same procedure as that of Example 1 except that KBP-90 (hydrolysate of 3-aminopropyltrimethoxysilane, effective concentration: 32%, manufactured by Shin-Etsu Chemical Co., Ltd.) was used as the hydrolysate of the amino group-containing silane coupling agent.

Example 5

The test sheet was prepared by following the same procedure as that of Example 1 except that XS-1003 (a methanol solution of N,N-bis[3-(trimethoxysilyl)propyl]ethylenediamine, effective concentration: 50%, manufactured by Chisso Co., Ltd.) was used as the hydrolysate of the amino group-containing silane coupling agent.

Example 6

The test sheet was prepared by following the same procedure as that of Example 2 except that the concentration of the amino group-containing silane coupling agent was changed to 5 ppm.

Example 7

The test sheet was prepared by following the same procedure as that of Example 2 except that the concentration of the amino group-containing silane coupling agent was changed to 5000 ppm.

Example 8

The test sheet was prepared by following the same procedure as that of Example 2 except that the metal material was changed to galvanized steel sheet (GA steel sheet, manufactured by Nippon Testpanel Co., Ltd., 70 mm×150 mm×0.8 mm).

Example 9

The test sheet was prepared by following the same procedure as that of Example 2 except that the metal material was changed to 5000 series aluminum (manufactured by Nippon Testpanel Co., Ltd., 70 mm×150 mm×0.8 mm).

Example 10

The test sheet was prepared by following the same procedure as that of Example 1 except that degreasing was performed by using "SURF CLEANER EC92" (degreasing agent manufactured by Nippon Paint Co., Ltd.) in place of "SURF CLEANER 53"; a GA steel sheet was immersed for 90 seconds using a chemical conversion coating agent which was prepared by blending 30 ppm of manganese nitrate, 100 ppm of barium nitrate and 30 ppm of sodium silicate as well as fluorozirconic acid, KBP-90 and tartaric acid in concentrations shown in Table 1 and by adjusting a pH to 3 and a temperature to 35° C.; and the duration of spraying using ion-exchanged water in rinsing after chemical conversion treatment was changed to 30 seconds and the metal material was coated after being dried at 80° C. for 5 minutes.

Examples 11~36

The test sheet was prepared by following the same procedure as that of Example 1 except that the chemical conversion coating agents were prepared by using magnesium nitrate and zinc nitrate as adhesion and corrosion resistance imparting agent, and Sila-Ace S-330 and Sila-Ace S-320 (manufactured by Chisso Co., Ltd.) in concentrations shown in Tables 1 and 2; and a steel sheet plated with zinc or a zinc-based alloy through hot dipping (GI, manufactured by Nippon Testpanel Co., Ltd., 70 mm×150 mm×0.8 mm), a steel sheet plated with zinc or a zinc-based alloy through electroplating (EG, manufactured by Nippon Testpanel Co., Ltd., 70 mm×150 mm×0.8 mm), a steel sheet with mill scale (SS400, manufactured by Nippon Testpanel Co., Ltd., 70 mm×150 mm×0.8 mm), and 5000 series aluminum (manufactured by Nippon Testpanel Co., Ltd., 70 mm×150 mm×0.8 mm) are used as material.

Comparative Example 1

The test sheet was prepared by following the same procedure as that of Example 1 except that the amino group-containing silane coupling agent was not blended.

Comparative Example 2

The test sheet was prepared by following the same procedure as that of Example 1 except that the fluorozirconic acid was not blended.

Comparative Example 3

The test sheet was prepared by following the same procedure as that of Example 1 except that the fluorozirconic acid was not blended and Sila-Ace S-330 was used as an amino group-containing silane coupling agent.

Comparative Example 4

The test sheet was prepared by following the same procedure as that of Example 1 except that degreasing was performed by using "SURF CLEANER EC92" in place of "SURF CLEANER 53"; a chemical conversion coating agent, formed by blending fluorozirconic acid and citric acid iron (III) ammonium in concentrations shown in Table 2, was used; and the duration of spraying using ion-exchanged water in rinsing after chemical conversion treatment was changed to 30 seconds.

Comparative Examples 5~9

The test sheet was prepared by following the same procedure as that of Example 1 except that chemical conversion treatment was performed by conditioning the surface at room temperature for 30 seconds using "SURF FINE 5N-8M" (manufactured by Nippon Paint Co., Ltd.) after rinsing with water after degreasing and by immersing the test sheet at 35° C. for 2 minutes using "SURF DYNE SD-6350" (a zinc phosphate-based chemical conversion coating agent manufactured by Nippon Paint Co., Ltd.).

TABLE 1

| | | Zirconium | Adhesion and corrosion resistance imparting agent | | Silane coupling agent | | Chemical | | | | | | |
|---|---|---|---|---|---|---|---|---|---|---|---|---|---|
| | | concentration (in treating agent, ppm) | Kind | Concentration (ppm) | Kind | Concentration (ppm) | conversion reaction accelerator | Material | Coat amount (mg/m$^2$) | Sludge | Coating | SDT | SST (mm) |
| Examples | 1 | 100 | — | 0 | KBM-603 | 100 | — | SPC | 12 | ○ | POWERNIX | ○ | 2.1 |
| | 2 | 100 | — | 0 | KBM-903 | 100 | — | SPC | 30 | ○ | 110 | ◎ | 1.3 |
| | 3 | 100 | — | 0 | KBE-903 | 100 | — | SPC | 36 | ○ | (Electrodeposition) | ◎ | 1.1 |
| | 4 | 100 | — | 0 | KBP-90 | 100 | — | SPC | 36 | ○ | | ◎ | 1.1 |
| | 5 | 100 | — | 0 | XS-1003 | 100 | — | SPC | 20 | ○ | | ◎ | 1.3 |
| | 6 | 100 | — | 0 | KBM-903 | 5 | — | SPC | 26 | ○ | | ○ | 1.8 |
| | 7 | 100 | — | 0 | KBM-903 | 5000 | — | SPC | 9 | ○ | | ◎ | 1.3 |
| | 8 | 100 | — | 0 | KBM-903 | 100 | — | GA | 15 | ○ | | ◎ | 1.2 |
| | 9 | 100 | — | 0 | KBM-903 | 100 | — | 5000Al | 18 | ○ | | ◎ | 1.3 |
| | 10 | 4000 | — | 0 | KBP-90 | 100 | Tartaric acid (2500 ppm) | GA | 178 | ○ | | ◎ | — |
| | 11 | 500 | — | 0 | S-330 | 500 | — | SPC | 27 | ○ | | ○ | 1.8 |
| | 12 | 300 | — | 0 | S-330 | 300 | — | SPC | 30.6 | ○ | | ◎ | 1.3 |
| | 13 | 200 | — | 0 | S-330 | 200 | — | SPC | 31.2 | ○ | | ◎ | 1.5 |
| | 14 | 100 | — | 0 | S-330 | 100 | — | SPC | 22.4 | ○ | | ◎ | 1.3 |
| | 15 | 50 | — | 0 | S-330 | 50 | — | SPC | 11.3 | ○ | | ◎ | 1.2 |
| | 16 | 500 | — | 0 | S-330 | 100 | — | SPC | 37.2 | ○ | | ◎ | 1.5 |
| | 17 | 500 | — | 0 | S-330 | 300 | — | SPC | 31.2 | ○ | | ◎ | 1.4 |
| | 18 | 500 | — | 0 | S-330 | 500 | — | SPC | 29.4 | ○ | | ◎ | 1.1 |
| | 19 | 500 | — | 0 | S-330 | 700 | — | SPC | 26.4 | ○ | | ○ | 1.9 |
| | 20 | 200 | — | 0 | S-330 | 50 | — | SPC | 24.6 | ○ | | ◎ | 1.5 |
| | 21 | 200 | — | 0 | S-330 | 100 | — | SPC | 22.4 | ○ | | ◎ | 1.6 |
| | 22 | 200 | — | 0 | S-330 | 300 | — | SPC | 9.8 | ○ | | ○ | 2 |
| | 23 | 200 | — | 0 | S-330 | 500 | — | SPC | 16.2 | ○ | | ○ | 1.9 |
| | 24 | 200 | — | 0 | S-320 | 50 | — | SPC | 42.9 | ○ | | ◎ | 1.3 |
| | 25 | 200 | — | 0 | S-320 | 100 | — | SPC | 43.5 | ○ | | ◎ | 1.3 |
| | 26 | 200 | — | 0 | S-320 | 200 | — | SPC | 36.6 | ○ | | ○ | 1.8 |

TABLE 2

| | | Zirconium | Adhesion and corrosion resistance imparting agent | | Silane coupling agent | | Chemical | | | | | | |
|---|---|---|---|---|---|---|---|---|---|---|---|---|---|
| | | concentration (in treating agent, ppm) | Kind | Concentration (ppm) | Kind | Concentration (ppm) | conversion reaction accelerator | Material | Coat amount (mg/m$^2$) | Sludge | Coating | SDT | SST (mm) |
| Examples | 27 | 200 | Mg | 100 | S-330 | 200 | — | SPC | 48.3 | ○ | POWERNIX | ◎ | 1.1 |
| | 28 | 200 | Mg | 500 | S-330 | 200 | — | SPC | 45.3 | ○ | 110 | ◎ | 1.3 |
| | 29 | 200 | Zn | 100 | S-330 | 200 | — | SPC | 37.2 | ○ | (Electrodeposition) | ◎ | 1.2 |
| | 30 | 200 | Zn | 500 | S-330 | 200 | — | SPC | 39.3 | ○ | | ◎ | 1.4 |
| | 31 | 200 | Mg/Zn | 100/100 | S-330 | 200 | — | SPC | 34.5 | ○ | | ◎ | 1.5 |
| | 32 | 200 | Mg/Zn | 500/500 | S-330 | 200 | — | SPC | 32.4 | ○ | | ◎ | 1.3 |
| | 33 | 200 | — | 0 | S-330 | 200 | — | GI | 35 | ○ | | | 2 |
| | 34 | 200 | — | 0 | S-330 | 200 | — | EG | 22.7 | ○ | | | 12 |
| | 35 | 200 | — | 0 | S-330 | 200 | — | SS400 | 30.6 | ○ | | | 2.9 |
| | 36 | 200 | — | 0 | S-330 | 200 | — | 6000Al | 19 | ○ | | ◎ | 0 |

TABLE 2-continued

| | | Zirconium concentration (in treating agent, ppm) | Adhesion and corrosion resistance imparting agent Kind | Adhesion and corrosion resistance imparting agent Concentration (ppm) | Silane coupling agent Kind | Silane coupling agent Concentration (ppm) | Chemical conversion reaction accelerator | Material | Coat amount (mg/m$^2$) | Sludge | Coating | SDT | SST (mm) |
|---|---|---|---|---|---|---|---|---|---|---|---|---|---|
| Compar. Ex. | 1 | 100 | — | 0 | — | 0 | — | SPC | 39 | ○ | | x | 4.5 |
| | 2 | 0 | — | 0 | KBM-603 | 100 | — | SPC | 0 | ○ | | x | 10.2 |
| | 3 | 0 | — | 0 | S-330 | 100 | — | SPC | 0 | ○ | | x | 10.4 |
| | 4 | 250 | — | 0 | — | 0 | citric acid iron (III) ammonium (0.5 ppm) | SPC | 25 | ○ | | x | — |
| | 5 | Treatment by zinc phosphate | | | | | — | SPC | | x | | ○ | 1.5 |
| | 6 | | | | | | — | GI | | x | | ○ | 3 |
| | 7 | | | | | | — | EG | | x | | x | 12.5 |
| | 8 | | | | | | — | SS400 | | x | | x | 3 |
| | 9 | | | | | | — | 6000Al | | x | | ◎ | 0.1 |

Examples 37~41

The test sheet was prepared by following the same procedure as that of Example 1 except that the chemical conversion coating agents and metal materials shown in Table 3 were used; "Orga select OTS 900 White" (a organic solvent coating composition manufactured by Nippon Paint Co., Ltd.) in place of "POWERNIX 110" (a cationic electrodeposition coating composition manufactured by Nippon Paint Co., Ltd.) was applied to the surface in such a manner that a dried film thickness was 35±2 μm; and the metal materials were heated and baked at 140° C. for 30 minutes.

Comparative Examples 10~14

The test sheet was prepared by following the same procedure as that of Comparative Example 4 except that metal materials shown in Table 3 were used; "Orga select OTS 900 White" (a organic solvent coating composition manufactured by Nippon Paint Co., Ltd.) in place of "POWERNIX 110" (a cationic electrodeposition coating composition manufactured by Nippon Paint Co., Ltd.) was applied to the surface in such a manner that a dried film thickness was 35±2 μm; and the metal materials were heated and baked at 140° C. for 30 minutes.

Examples 42~46

The test sheet was prepared by following the same procedure as that of Example 1 except that the chemical conversion coating agents and metal materials shown in Table 3 were used; "Eau de Ecoline OEL 100" (a water-borne coating composition manufactured by Nippon Paint Co., Ltd.) in place of "POWERNIX 110" (a cationic electrodeposition coating composition manufactured by Nippon Paint Co., Ltd.) was applied to the surface in such a manner that a dried film thickness was 35±2 μm; and the metal materials were heated and baked at 140° C. for 30 minutes.

Comparative Examples 15~19

The test sheet was prepared by following the same procedure as that of Comparative Example 4 except that metal materials shown in Table 3 were used; "Eau de Ecoline OEL 100" (a water-borne coating composition manufactured by Nippon Paint Co., Ltd.) in place of "POWERNIX 110" (a cationic electrodeposition coating composition manufactured by Nippon Paint Co., Ltd.) was applied to the surface in such a manner that a dried film thickness was 35±2 μm; and the metal materials were heated and baked at 140° C. for 30 minutes.

Examples 47~51

The test sheet was prepared by following the same procedure as that of Example 1 except that the chemical conversion coating agents and metal materials shown in Table 3 were used; "Powdax P100" (a powder coating composition manufactured by Nippon Paint Co., Ltd.) in place of "POWERNIX 110" (a cationic electrodeposition coating composition manufactured by Nippon Paint Co., Ltd.) was applied to the surface in such a manner that a dried film thickness was 100±15 μm; and the metal materials were heated and baked at 180° C. for 20 minutes.

Comparative Examples 20~24

The test sheet was prepared by following the same procedure as that of Comparative Example 4 except that metal materials shown in Table 3 were used; "Powdax P 100" (a powder coating composition manufactured by Nippon Paint Co., Ltd.) in place of "POWERNIX 110" (a cationic electrodeposition coating composition manufactured by Nippon Paint Co., Ltd.) was applied to the surface in such a manner that a dried film thickness was 100±5 μm; and the metal materials were heated and baked at 180° C. for 20 minutes.

TABLE 3

| | | Zirconium | Adhesion and corrosion resistance imparting agent | | Silane coupling agent | | | | | | | |
|---|---|---|---|---|---|---|---|---|---|---|---|---|
| | | concentration (in treating agent, ppm) | Kind | Concentration (ppm) | Kind | Concentration (ppm) | Material | Coat amount ($mg/m^2$) | Sludge | Coating | SST (mm) | Humidity resistance |
| Ex. | 37 | 200 | — | 0 | S-330 | 200 | SPC | 36.3 | o | OTS900 | 1.9 | 100/100 |
| | 38 | 200 | — | 0 | S-330 | 200 | GI | 33.4 | o | White | 2 | 100/100 |
| | 39 | 200 | — | 0 | S-330 | 200 | EG | 20.6 | o | (Solvent | 4.8 | 100/100 |
| | 40 | 200 | — | 0 | S-330 | 200 | SS400 | 31.5 | o | coating) | 13.5 | 100/100 |
| | 41 | 200 | — | 0 | S-330 | 200 | 6000Al | 18.6 | o | | 0.5 | 100/100 |
| Compar. | 10 | Treatment by zinc phosphate | | | | | SPC | | x | | 6 | 0/100 |
| Ex. | 11 | | | | | | GI | | x | | 5 | 0/100 |
| | 12 | | | | | | EG | | x | | 4.5 | 100/100 |
| | 13 | | | | | | SS400 | | x | | 14 | 0/100 |
| | 14 | | | | | | 6000Al | | x | | 2.5 | 0/100 |
| Ex. | 42 | 200 | — | 0 | S-330 | 200 | SPC | 35.4 | o | OEL100 | 3 | 100/100 |
| | 43 | 200 | — | 0 | S-330 | 200 | GI | 34.5 | o | (Water- | 0.5 | 100/100 |
| | 44 | 200 | — | 0 | S-330 | 200 | EG | 23 | o | borne | 10 | 0/100 |
| | 45 | 200 | — | 0 | S-330 | 200 | SS400 | 33 | o | coating) | 12.5 | 100/100 |
| | 46 | 200 | — | 0 | S-330 | 200 | 6000Al | 19.1 | o | | 0.7 | 100/100 |
| Compar. | 15 | Treatment by zinc phosphate | | | | | SPC | | x | | 4.6 | 0/100 |
| Ex. | 16 | | | | | | GI | | x | | 2.2 | 0/100 |
| | 17 | | | | | | EG | | x | | 6.5 | 50/100 |
| | 18 | | | | | | SS400 | | x | | 13 | 100/100 |
| | 19 | | | | | | 6000Al | | x | | 5 | 0/100 |
| Ex. | 47 | 200 | — | 0 | S-330 | 200 | SPC | 33.6 | o | Powdax | 3 | 100/100 |
| | 48 | 200 | — | 0 | S-330 | 200 | GI | 36.5 | o | P100 | 1.2 | 100/100 |
| | 49 | 200 | — | 0 | S-330 | 200 | EG | 22.5 | o | (Powder | 10 | 100/100 |
| | 50 | 200 | — | 0 | S-330 | 200 | SS400 | 29.7 | o | coating) | 1.6 | 100/100 |
| | 51 | 200 | — | 0 | S-330 | 200 | 6000Al | 19.3 | o | | 0 | 100/100 |
| Compar. | 20 | Treatment by zinc phosphate | | | | | SPC | | x | | 1.4 | 100/100 |
| Ex. | 21 | | | | | | GI | | x | | 4.6 | 100/100 |
| | 22 | | | | | | EG | | x | | 12 | 100/100 |
| | 23 | | | | | | SS400 | | x | | 8 | 100/100 |
| | 24 | | | | | | 6000Al | | x | | 0 | 100/100 |

Tables 1 to 3 show that there was not the formation of sludge in the chemical conversion coating agent used in Examples. Further it shows that the chemical conversion coat obtained by using pretreatment method for coating of the present invention has the good adhesion to a coating film attained by various coatings. On the other hand, the chemical conversion coating agent used in Comparative Examples could not suppresses the formation of sludge and could not attain the chemical conversion coat which has excellent adhesion to a coating film.

The invention claimed is:

1. A cation electrodeposition method which comprises conducting surface treatment on a metal material for automobile body and automobile parts by a chemical conversion coating agent to form a chemical conversion coat, then washing the metal material with water without drying, which is coated with the chemical conversion coat, and then conducting cation electrodeposition coating on the chemical conversion coat, wherein the chemical conversion coating agent comprises: at least one member selected from the group consisting of zirconium, titanium and hafnium having a content of 50 to 2000 ppm on the basis of metal; and fluorine; and at least one member selected from the group consisting of amino group-containing silane coupling agent, hydrolysates thereof and polymers thereof; and having substantially no phosphate ion, said at least one member is selected from the group consisting of amino group containing silane coupling agent, hydrolysates thereof and polymers thereof, has a content of 50 to 500 ppm as a concentration of solid matter, said chemical conversion coating agent has a pH of 1.5 to 6.5, and said metal material comprises at least iron material.

2. The cation electrodeposition method according to claim 1, wherein the chemical conversion coating agent contains 1 to 5,000 ppm of at least one member of a chemical conversion reaction accelerator selected from the group consisting of nitrite ion, nitro group-containing compounds, hydroxylamine sulfate, persulfate ion, sulfite ion, hyposulfite ion, peroxides, iron (III) ion, citric acid iron compounds, bromate ion, perchlorinate ion, chlorate ion, chlorite ion, ascorbic acid, citric acid, tartaric acid, malonic acid, succinic acid and salts thereof.

3. The cation electrodeposition method according to claim 1, wherein the amino group-containing silane coupling agent is selected from the group consisting of N-2-(aminoethyl)-3-aminopropyltrimethoxysilane, and 3-aminopropyltrimethoxysilane.

4. The cation electrodeposition method according to claim 1, wherein the chemical conversion coating agent contains polymers of an amino group-containing silane coupling agent.

5. The cation electrodeposition method according to claim 1, wherein the chemical conversion coating agent contains at least one adhesion and corrosion resistance imparting agent selected from the group consisting of magnesium ion, zinc ion, calcium ion, aluminum ion, gallium ion, indium ion, and copper ion.

6. The cation electrodeposition method according to claim 5, wherein the adhesion and corrosion resistance imparting agent is selected from the group consisting of aluminum ion and copper ion.

7. The cation electrodeposition method according to claim 5, wherein the adhesion and corrosion resistance imparting agent is selected from the group consisting of magnesium ion and zinc ion.

8. The cation electrodeposition method according to claim 1, wherein the water is ion exchange water.

9. The cation electrodeposition method according to claim 1, wherein the metal material partially comprises iron, aluminum and zinc materials.

* * * * *